US006220876B1

(12) United States Patent
Avila et al.

(10) Patent No.: US 6,220,876 B1
(45) Date of Patent: Apr. 24, 2001

(54) ELECTRICAL INTERCONNECT SYSTEM AND METHOD FOR INTEGRATING A BUSSED ELECTRICAL DISTRIBUTION CENTER WITH A PRINTED CIRCUIT BOARD

(75) Inventors: Andres Eduardo Avila; David Jay Vess, both of Kokomo; Kevin Joseph Hawes, Greentown, all of IN (US); Joseph Howard Gladd, Cortland, OH (US); Dominic Carano, Hubbard, OH (US); Richard Alan Natoli, Girard, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/448,752

(22) Filed: Nov. 24, 1999

Related U.S. Application Data

(63) Continuation-in-part of application No. 09/163,138, filed on Sep. 29, 1998, now Pat. No. 6,000,952.

(51) Int. Cl.[7] ..... H01R 12/00

(52) U.S. Cl. ..... 439/76.2; 439/34; 439/66; 439/78; 439/83; 439/700; 439/775; 439/824

(58) Field of Search ..... 439/66, 76.2, 700, 439/824, 83, 949, 775, 78, 34

(56) References Cited

U.S. PATENT DOCUMENTS

| | | | |
|---|---|---|---|
| 3,701,984 | 10/1972 | Burns | 340/173 |
| 3,897,126 | 7/1975 | Frances et al. | 339/17 |
| 4,689,718 | 8/1987 | Maue et al. | 361/360 |
| 5,653,607 | 8/1997 | Saka et al. | 439/402 |
| 5,715,135 | 2/1998 | Brussalis et al. | 361/624 |
| 5,788,529 | 8/1998 | Borzi et al. | 439/364 |
| 5,831,814 | 11/1998 | Hamill | 361/627 |

*Primary Examiner*—Hien Vu
*Assistant Examiner*—Truc Nguyen
(74) *Attorney, Agent, or Firm*—Jimmy L. Funke

(57) ABSTRACT

An integrated BEDC and PCB provided through a low cost, highly reliable interconnect system. The upper and/or lower half of the main insulation assembly of a BEDC is provided with a recess for accommodating at least an edge portion of the substrate of a PCB. The PCB is provided with apertures such as holes for receiving therethrough a bus wire and/or terminal slots through which terminals having wire slots are fixedly staked. The apertures on the PCB are arranged in a predetermined pattern so as to align with corresponding respective apertures in the form of corresponding holes and/or terminal slots on the BEDC at the recess thereof. Accordingly, with the PCB seated in the recess, as the bus wires are laid, they will pass through the holes in the PCB and/or pass through the wire slots of the terminals and thereby provide interconnection therebetween when the two halves of the main insulation assembly are united and the PCB is sandwiched therebetween. Additionally, the electrical interconnect system includes a flexible strain relief bend formed on the bus wire to provide a flexible connection.

9 Claims, 7 Drawing Sheets

FIG. 7
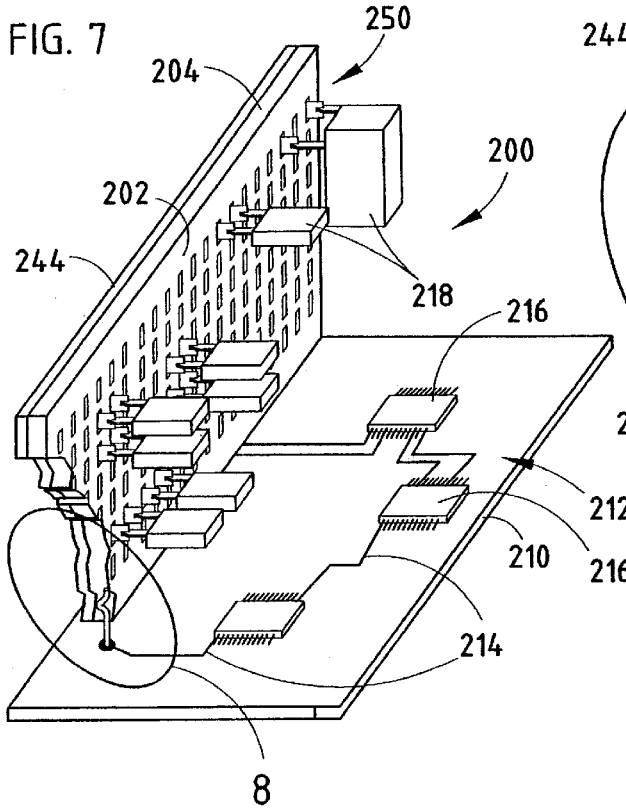
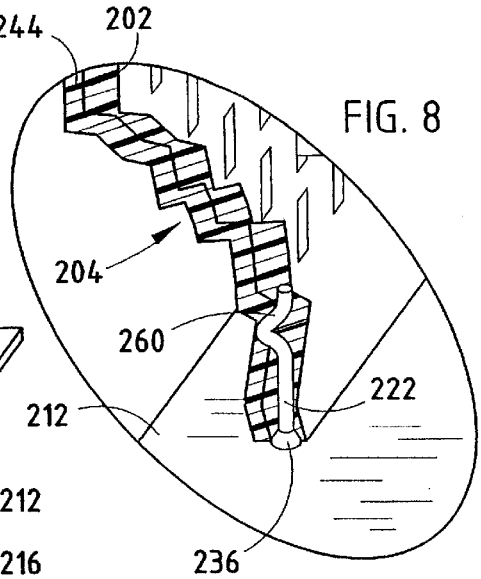
FIG. 8
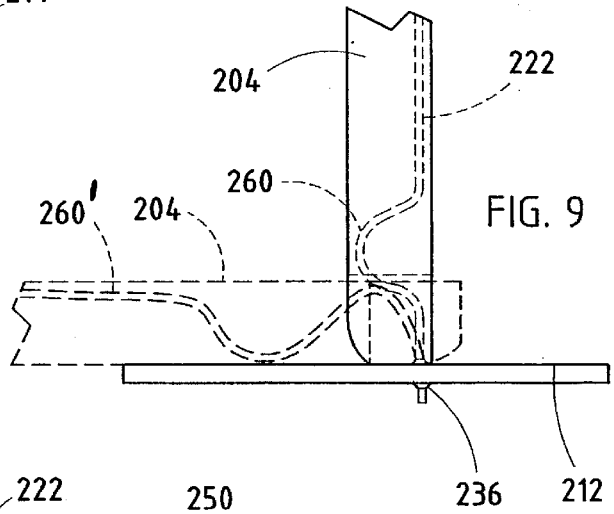
FIG. 9
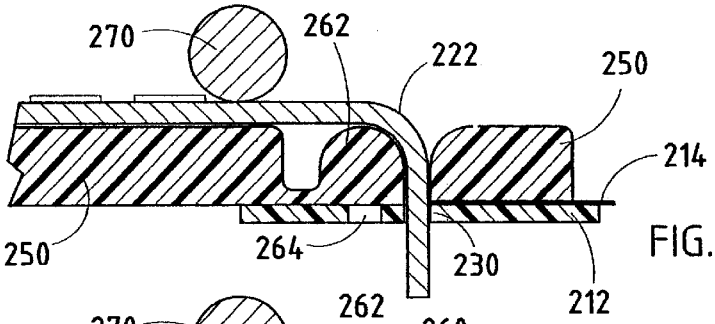
FIG. 10
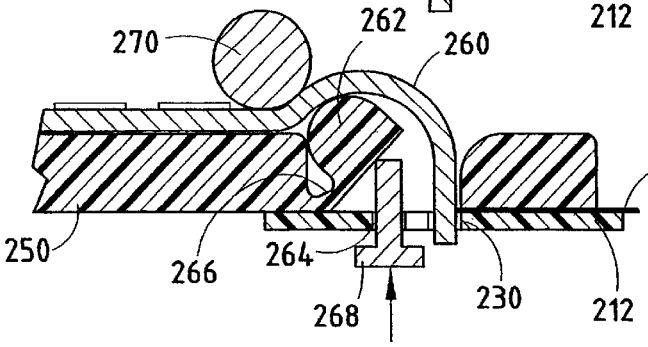
FIG. 11

ELECTRICAL INTERCONNECT SYSTEM AND METHOD FOR INTEGRATING A BUSSED ELECTRICAL DISTRIBUTION CENTER WITH A PRINTED CIRCUIT BOARD

RELATED APPLICATION

The present application is a continuation-in-part of commonly owned U.S. patent application Ser. No. 09/163,138, filed Sep. 29, 1998, entitled "INTERCONNECT SYSTEM FOR INTEGRATING A BUSSED ELECTRICAL DISTRIBUTION CENTER WITH A PRINTED CIRCUIT BOARD," now U.S. Pat. No. 6,000,952.

TECHNICAL FIELD

The present invention relates to bussed electrical distribution centers having bussed circuits and/or various electronic components and to printed circuit boards composed of a dielectric substrate having various side-mounted and stick-leaded electronic components, and more particularly to an interconnect system for providing a direct connection therebetween.

BACKGROUND OF THE INVENTION

A bussed electrical distribution center (hereinafter referred to simply as a "BEDC") is a stand-alone central junction block assembly which has gained increasing applications in the automotive arts as motor vehicles become ever more electronically sophisticated. BEDC's package, for example, various fuses, relays and electronic devices in a single central location. BEDCs not only save cost by consolidating electrical interconnections, but also advantageously reduce the number of cut and spliced leads, thereby increasing reliability.

A BEDC construction which is considered state of the art is described in U.S. Pat. No. 5,715,135, to Brussalis et al., dated Feb. 3, 1998, which is assigned to the assignee of the present invention, the disclosure of which is hereby incorporated by reference herein.

In the BEDC described in U.S. Pat. No. 5,715,135, a two-piece main insulation assembly is provided. Stamped male blade or tuning fork terminals are press-fit between the main insulation assembly, wherein the terminals are provided with a wire slot. The upper half of the main insulation assembly has a top surface provided with a plurality of terminal stations and guide stations that are raised and separated from each other so as to provide a network of channels that provide wire passages. The terminal stations have IDC (insulation displacement) type terminal slots that extend through the upper half of the main insulation assembly and allow a press-fit affixment of the terminals, wherein the wiring slots thereof intersect the wiring passages. The lower half of the main insulation assembly is configured similarly. When a segment of bus wire (preferably solid copper) is routed selectively along the wiring channels, the bus wire segment is pressed through the wire slot of a selected number of the terminals to thereby electrically connect those terminals therewith.

A printed circuit board (hereinafter simply referred to as a "PCB"), is a board-like, electrically interfaced package of electronic components which has become ubiquitous in the electrical arts. PCBs typically are in the form of a dielectric substrate (such as for example an organic resin reinforced by fibers) and a predetermined pattern of perforations for making connections with wiring and electrical devices, wherein a conductive path, usually cladded copper, is patterned so as to provide a predetermined electrical routing between the perforations so that the wiring and electrical devices are functionally interconnected.

Referring now to FIG. 1, a prior art interconnection system for electrically interfacing a BEDC with a PCB is depicted for an automotive environment of operation. In this automotive environment, a BEDC 10 is connected by a wiring harness 12 to a PCB 14. At each connection of the wiring harness 12, a connector 16, 18 is required. Further, the connectors 16, 18 must be enlarged, or additional connectors must be provided, in order to interface with separate wiring 20, 22 that must communicate with various electrical components of the motor vehicle.

The prior art interconnection system of FIG. 1 has several disadvantages, among these are: high cost of interface via a wiring harness; lower reliability due to use of numerous connectors; large volume of space allocated for the separate BEDC and PCB; and intensive assembly labor; limited flexibility in configuring the interconnection system; and susceptibility to weakened soldered connections. Accordingly, what remains needed in the art is a connection system for providing an integrated BEDC and PCB that is flexible, resistant t o electrical disconnection, and easy to make at low cost.

SUMMARY OF THE INVENTION

In accordance with the teachings of the present invention, an interconnect system and method are provided for directly connecting a printed circuit board to a bussed electrical distribution center. The system includes a bussed electrical distribution center having a main assembly and at least one bus wire. Also included is a printed circuit board having a substrate and a conductive path fabricated thereon. An electrical interconnect connects the at least one bus wire on the bussed electrical distribution center with the conductive path on the printed circuit board, and the interconnect has a flexible bend located between the bussed electrical distribution center and printed circuit board to provide a flexible strain relieved interconnection.

Accordingly, the interconnect system and method of the present invention provide for the connection of a PCB to a BEDC with enhanced reliability and requires minimal assembly labor. The present invention provides enhanced flexibility in the electrical connection to minimize the likelihood of electrical disconnection due to vibration or other adverse forces. The present invention further obviates the need for wiring harnesses, and provides minimized component volume.

These, and additional objects, advantages, features and benefits of the present invention will become apparent from the following specification.

BRIEF DESCRIPTION OF THE DRAWINGS

The present invention will now be described, by way of example, with reference to the accompanying drawings, in which:

FIG. 7 is a perspective view of an integrated BEDC and PCB electrically connected via an interconnect system according to another embodiment of the present invention;

FIG. 8 is an exploded sectional view of one electrical interconnection between the BEDC and PCB shown in FIG. 7;

FIG. 9 is a schematic view of a portion of the BEDC and PCB shown in both the L-shape and flat pack configurations;

FIG. 10 is a partial cross-sectional view of a BEDC and PCB illustrating a hinged assembly process for forming a flexible strain relief bend in the electrical interconnection according to another embodiment;

FIG. 11 is a partial cross-sectional view of the BEDC and PCB shown in FIG. 10, further illustrating the formation of the flexible bend in the electrical interconnection;

DETAILED DESCRIPTION OF THE PREFERRED EMBODIMENTS

Figure 1:
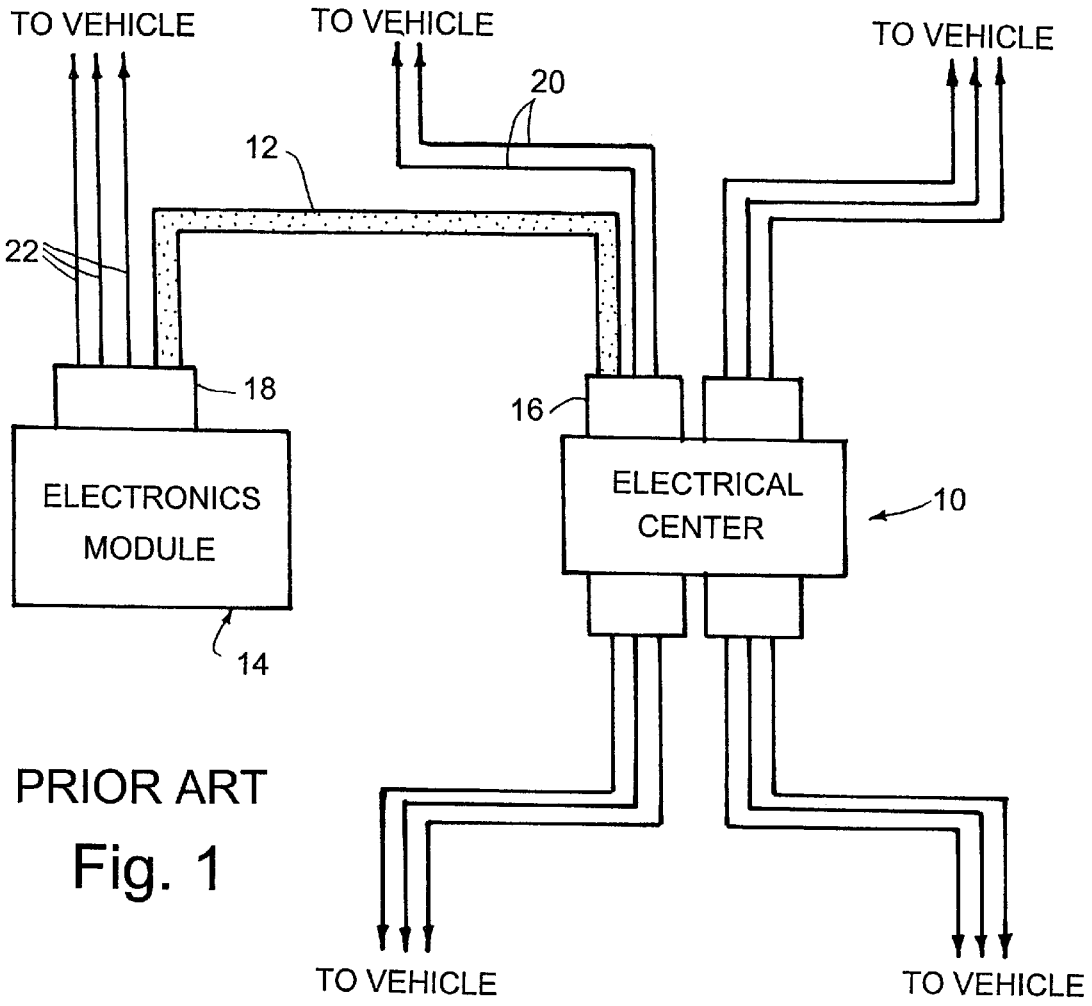
PRIOR ART Fig. 1
FIG. 1 is a schematic view of a prior art connection system for connecting a PCB to a BEDC.

Referring now to the drawings, FIGS. 2*a*–2*e* depict a series of steps according to the interconnect system 100 of the present invention. In this regard, a bussed electrical distribution center (BEDC) described in U.S. Pat. No. 5,715,135 is utilized herein by way of example.

Figure 2A:
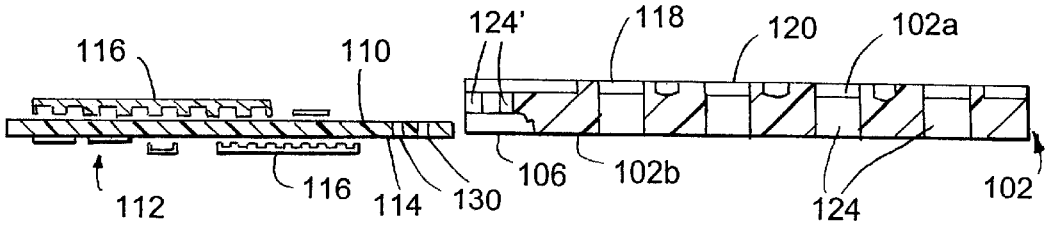
FIGS. 2*a*–2*e* are partly sectional side views illustrating steps for interconnecting a PCB with a BEDC according to the present invention.
Figure 2B:
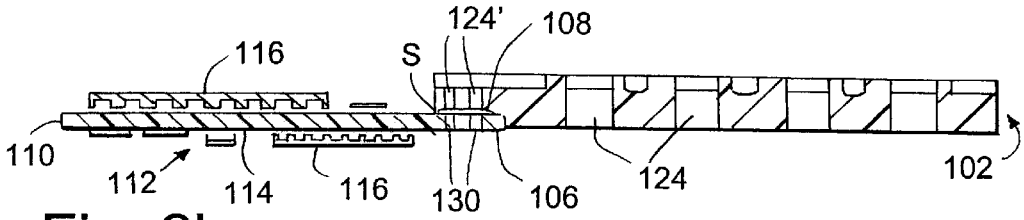

As indicated at FIG. 2*a*, an upper half member 102 of a two-piece main insulation assembly 104 (see FIG. 2*e*) is provided with a recess 106 at the inner face 102*b* thereof, wherein the inner face is preferably characterized by side rails and grooved beams in the manner described in U.S. Pat. No. 5,715,135. The recess 106 is located at an end portion of the upper half member 102 and provides seating of an end portion 108 of a substrate 110 of a populated printed circuit board (PCB) 112, wherein the seating preferably is abutting at the edge of the PCB and is separated by a spacing S adjacent the edge, as shown at FIG. 2*b*. The PCB 112 includes a conductive path 114 cladded to the substrate 110 and various electronic components 116 connected with the conductive path 114. Apertures 130 in the form of holes and/or slots are provided in the PCB 112 at the end portion 108.

As recounted in U.S. Pat. No. 5,715,135, the outer face 102*a* of the upper half member 102 is provided with various raised guides 118 for providing wiring channels 120 for bus wires 122 (shown best at FIGS. 4 and 5). As further recounted in U.S. Pat. No. 5,715,135, the upper half member 102 is further provided with apertures 124 in the form of terminal slots for fixedly receiving terminals 126 having wire slots 128 (see FIG. 2*d*).

When the end portion 108 is received seatingly into the recess 106, the apertures 130 align with respective apertures 124' in the form of corresponding holes and/or terminal slots on the BEDC at the recess.

Figure 2C:
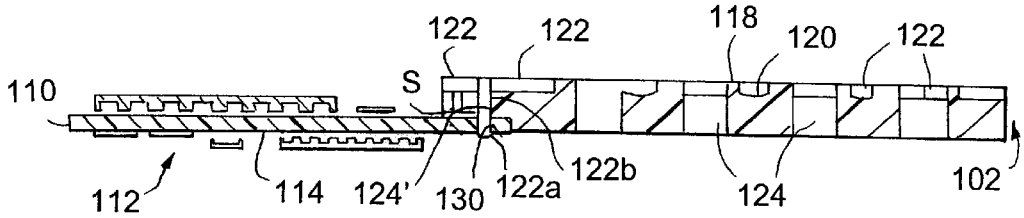

Next, the combined assemblage of the PCB 112 and upper half member 102 is placed in a bus wire routing machine where the bussed circuits for the BEDC are created. As shown at FIG. 2*c*, the bus wires 122 are laid in the wiring channels 120 in a predetermined pattern. The bus wires 122 are, where appropriate, planted through the apertures 130, 124' which are in the form of holes in the PCB 112 and the BEDC, respectively.

Figure 2D:
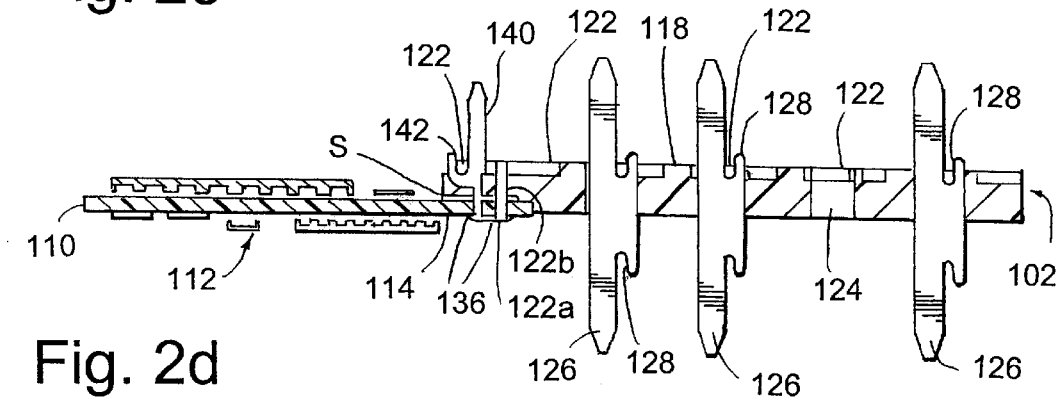

As shown at FIG. 2*d*, the terminals 126 are press-fit into the terminal slots 124 of the upper half member 102, and, where appropriate, the bus wires 122 are pressed into the wire slots 128 of the terminals 126. Similarly, where terminals 140 are placed into the apertures 130 of the PCB 112, where appropriate, the bus wires 122 press-fit into wire slots 142 thereof.

The end 122*a* of the planted portion 122*b* of the bus wires 122 are now soldered, via a solder joint 136 to the conductive path 114 of the PCB 112. Similarly, the planted end 132*a* of the terminals 132 is soldered, via another solder joint 136, to the electrically conductive path 114. In this regard, it is preferred to use a fountain wave soldering methodology that is well-known in the soldering arts.

Figure 2E:
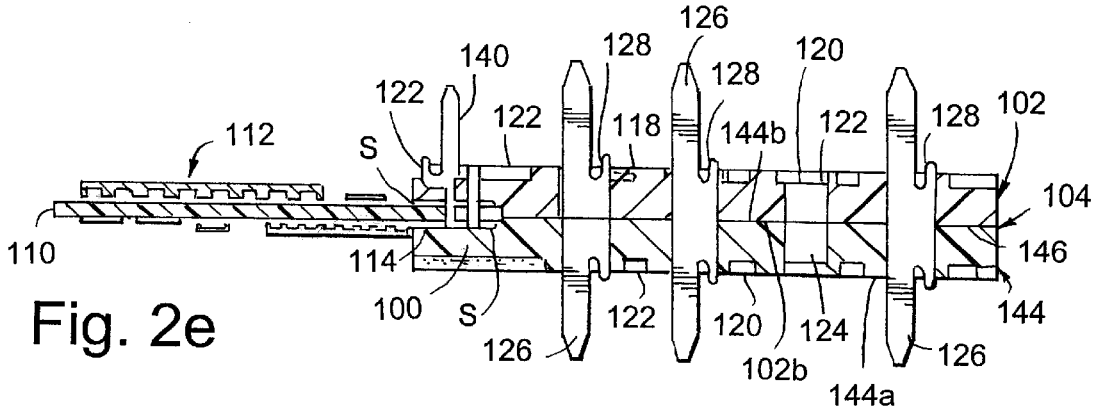

As shown in FIG. 2*e*, the lower half member 144 of the main insulation assembly 104 is configured similar to the upper half member 102, including the recess for receiving the PCB in the manner hereinabove described. Terminals 126 are similarly press-fit and bus wires 122 are similarly laid down in the wiring channels of the outer face thereof and press-fit into the wire slots 128 of the terminals. When the inner faces 102*b*, 144*b* of the upper and lower half members 102, 144 are brought into abutment to thereby assemble the main insulation assembly 104 of the BEDC, the substrate 110 is in alignment with the interface 146 therebetween and the recess serves to firmly sandwich the edge and afford spacings S adjacent thereto. Finally, the entire assembly is then cold staked to lock the terminals and PCB 112 in position relative to the upper and lower half members 102, 144. In this regard the upper and lower half members afford strain relief to the solder joints 136.

It will be noted that the interconnect system 100 provides simultaneously a mechanical and electrical direct interface between the PCB and the BEDC, wherein external wiring need only be connected through the BEDC.

Figure 3:
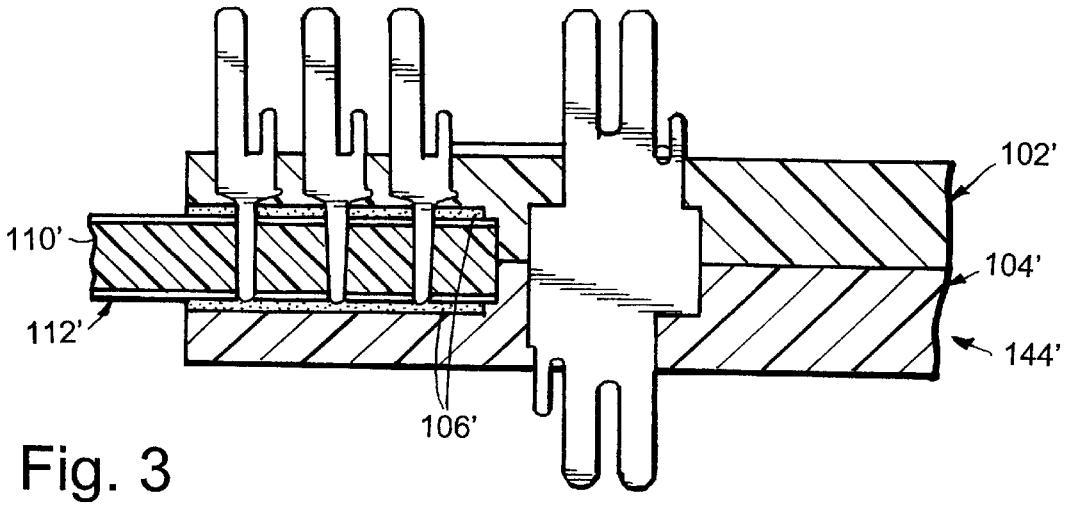
FIG. 3 is a detail, partly sectional view of an alternative configuration for mounting a PCB with respect to a BEDC according to the present invention.

FIG. 3 depicts a variation of the interconnect system, wherein a populated PCB 112' is integrated with a main insulation assembly 104', wherein each of the upper half member 102' and the lower half member 144' are provided with a portion of the recess 106', and wherein the substrate 110' is situated fixedly therein.

Figure 4:
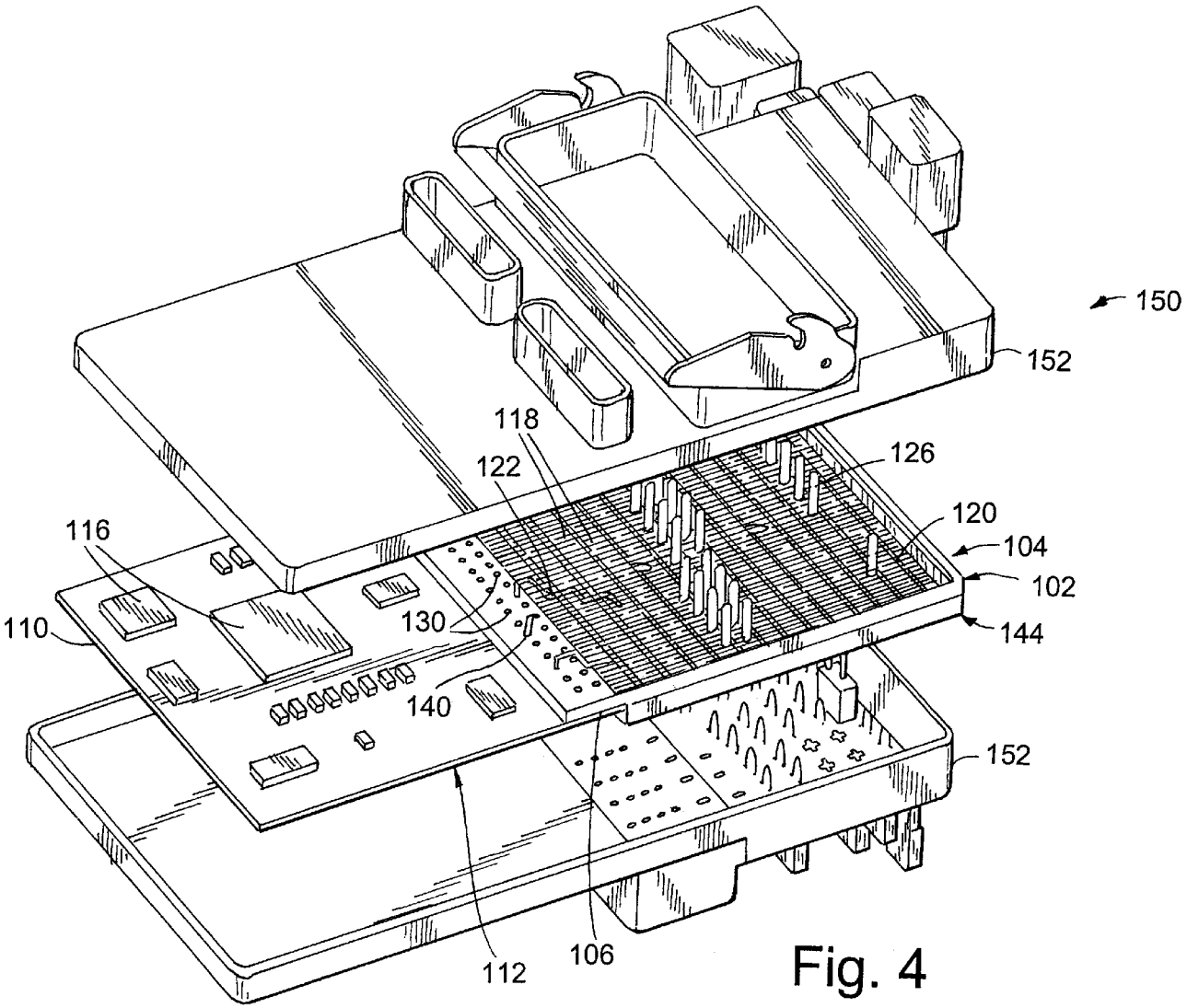
FIG. 4 is an exploded perspective view of a first example of an integrated BEDC and PCB according to the present invention.

FIG. 4 depicts an example for carrying out the interconnect system, wherein a BEDC 150 is integrated with the PCB 112, upper half member 102 and lower half member 144 of FIG. 2*e*. The PCB 112 is interfaced at the recess 106 of the upper half member 102, and the upper half member is interfaced with the lower half member 144 to form the main insulation assembly 104. The terminals 126, guides 118, wiring channels 120 and bus wires 122 are as described hereinabove with respect to FIGS. 2*a* through 2*e*. An enclosure 152 provides external electrical connections and environmental protection.

Figure 5:
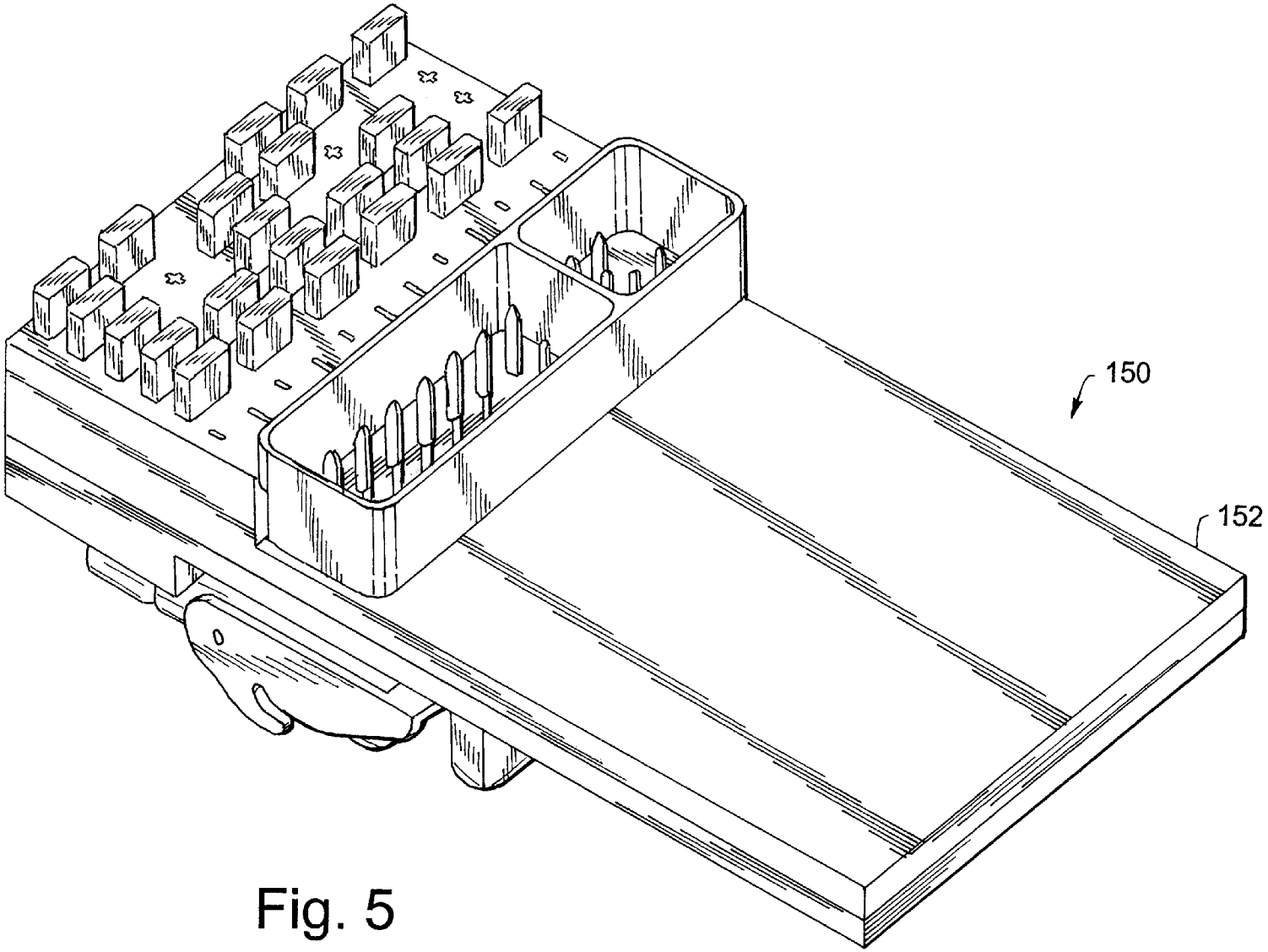
FIG. 5 is a perspective view of the integrated BEDC and PCB of FIG. 4 in a fully assembled state.

FIG. 5 depicts the integrated BEDC unit 150 in a fully assembled state.

Figure 6:
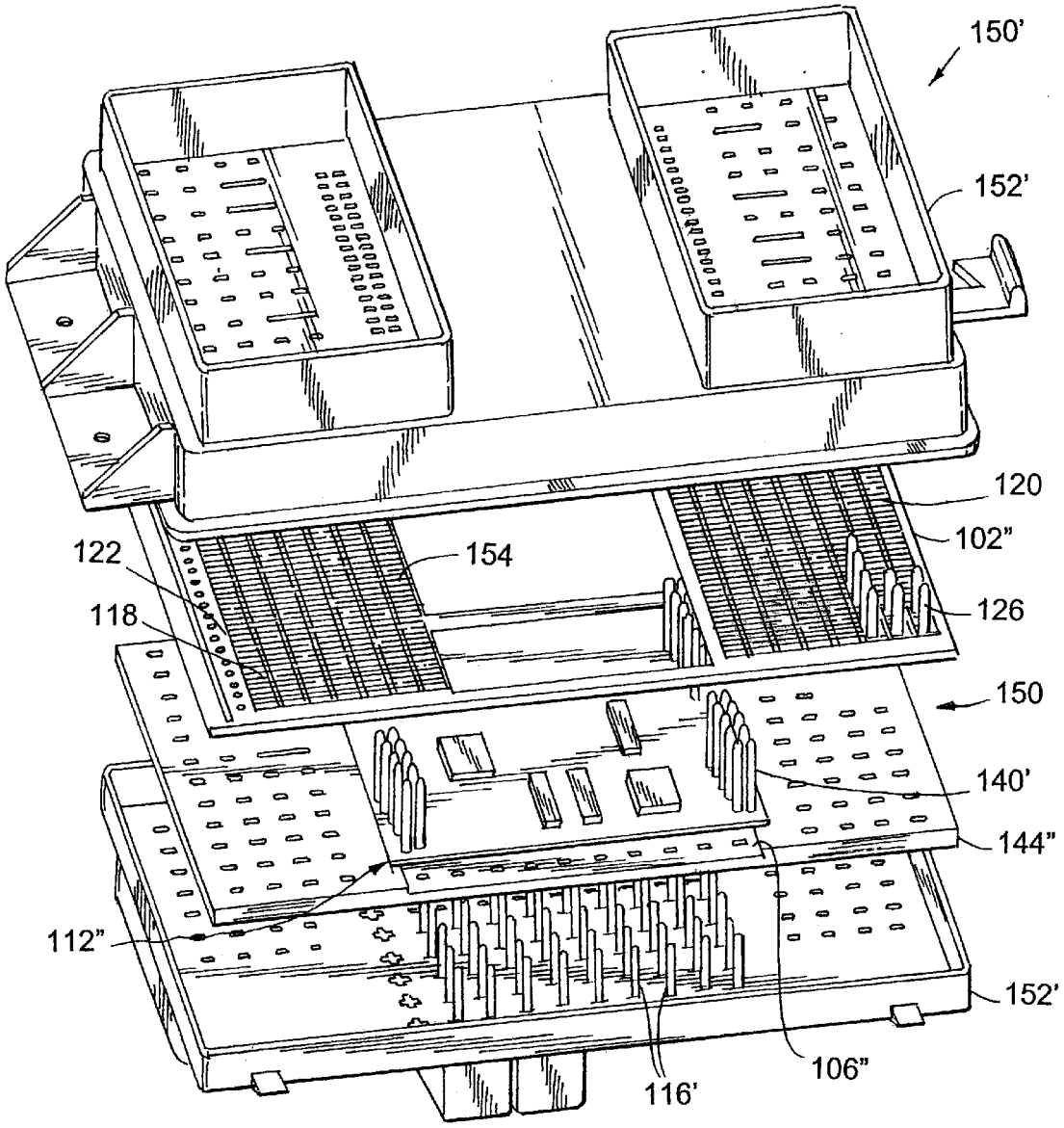
FIG. 6 is an exploded perspective view of a second example of an integrated BEDC and PCB according to the present invention.

FIG. 6 depicts a second example for carrying out the interconnect system 100, wherein a BEDC 150' includes a PCB 112" entirely received by a recess 106" of the lower half member 144" and the electronic components 116' project into an opening 154 formed in the upper half member 102". The terminals 140' are, at least in part, in the form of micro pack terminal pins. The terminals 126, guides 118, wiring channels 120 and bus wires 122 are as described hereinabove with respect to FIGS. *2a–2e*. An enclosure 152' provides external electrical connections and environmental protection.

Some of the distinguishing advantages of the interconnect system 100 are:

a) A conventional wiring harness connecting the PCB to the BEDC is eliminated, as are the associated connectors.

b) Custom routed bus wiring from the BEDC is solderingly connected to the PCB, thereby greatly enhancing reliability.

c) The number of parts and the amount of material is minimized because of a co-location design and a common enclosure.

d) Common mounting features and fewer connectors simplifies installation and minimizes connect labor.

e) Connection to external electronics is simplified, in that an integrated connector can accommodate BEDC electronics and PCB I/O.

f) The PCB may be used to achieve bussing of some low current circuits.

g) Solid state devices on the PCB may be used to replace pluggable mechanical relays of the BEDC.

Referring to FIG. 7, an interconnect system 200 for electrically interfacing a BEDC 250 with a PCB 212 is depicted according to another embodiment of the present invention. The interconnect system 200 is particularly well-suited, but is not limited, to use in an instrument panel of an automotive vehicle. The interconnect system 200 provides a low cost electrical interface that is flexible to allow for various package configurations such as an L-shaped configuration and a flat configuration.

The bussed electrical distribution center (BEDC) 250 is shown having a two-piece main insulation assembly 204 including an upper half member 202 and a lower half member 244 with bus wire 222 routed through wiring channels in the two-piece main insulation assembly 204. The BEDC 250 houses high-current electronic devices 218 which may include relays, fuses, splices, and other electronic devices. The printed circuit board 212 includes conductive paths 214 cladded to a substrate 210 and contains various low-current electronic components 216. The printed circuit board 212 is composed of various electronics 216 to drive the relays, communicate via serial data, condition and regulate the power supply, sense feedback from the relay devices, monitor low-current discrete inputs, drive low-current discrete outputs and process inbound or outgoing serial data. Examples of electronic devices 216 may include a processor, serial transceiver/protocol handler, relay driving integrated circuits, discrete parts, and application specific integrated circuits (ASICs). The printed circuit board 212 and BEDC 250 may be configured as described in connection with printed circuit board 112 or 112' and BEDC 150 or 150', respectively, as described above.

The BEDC 250 and printed circuit board 212 are electrically interconnected so that certain bus wires 222 are electrically coupled to certain conductive paths 214 to provide electrical signal transmission paths therebetween, while at the same time providing a physical interconnection between BEDC 250 and printed circuit board 212. With particular reference to FIG. 8, the interconnection between BEDC 250 and printed circuit board 212 is further shown therein. Bus wire 222 is shown extending through a channel in the two-piece main insulation assembly 204 and extends outward from the bottom edge through an aperture in the assembly 204 and into a wire termination aperture formed in the printed circuit board 212, where it is soldered in place via solder joint 236. The bus wire 222 has a flexible strain relief bend 260 formed therein, which may be in the shape of a partial or complete loop, that provides a flexible electrical interconnection which may utilize a standard solder process and is achieved at a low cost. According to the present invention, the routed bus wire 222 is bent in such a way as to facilitate its placement into a wire termination aperture formed in printed circuit board 212 and to reduce strain on the solder joint 236. The geometry of the flexible bend 260 may include a number of embodiments which may depend on the desired end package configuration for the module.

According to the embodiment shown in FIGS. 7 and 8, the routed bus wire 222 has a flexible bend 260 configured with reverse "S" geometry. The electrical interconnection is made by placing the bus wire 222 into a prepared through hole in the printed circuit board 212, and forming a solder joint 236, which may include a conventional soldering process, to solder the bus wire 222 to a conductive path 214 on printed circuit board 212.

The interconnect system 200 allows for an L-shape package configuration as shown in FIG. 7, and further allows the BEDC 250 to be rotated ninety degrees relative to the printed circuit board 212 to form a flat pack configuration as shown in FIG. 9. When rotating the BEDC 250 relative to the printed circuit board 212, the shape of the reverse S-shape flexible bend 260 changes and the flexible bend 260 stretches longitudinally to allow relative movement between the BEDC 250 and printed circuit board 212. The reverse S-shaped flexible bend 260 advantageously reduces the strain on the solder joint 236, and thereby reduces the possibility of damaging the solder joint 236, especially during movement of the BEDC 250 relative to the printed circuit board 212. According to the flat pack configuration, the interconnected assembly may be easily installed into a housing to complete the module assembly.

Referring to FIGS. 10 and 11, the formation of flexible bend 260 in bus wire 222 is illustrated therein for a flat pack configuration. According to this embodiment, the BEDC 250 has a hinged member 262 integrally formed in or connected to BEDC 250 via a reduced thickness hinge 266. Hinged member 262 lies on top of the printed circuit board 212 above an opening 264 formed therein. With the bus wire 222 inserted through a wire termination aperture 230 in the printed circuit board 212, a tool 268, such as a pin, is forcibly actuated upward through opening 264 to contact hinged member 262, which in turn is forced vertically upward to deform bus wire 222 and form the flexible bend 260 therein. To assist in formation of the flexible bend 260, a support member 270, such as a cylindrical anvil, may be employed to hold the bus wire 222 against BEDC 250. Once the flexible bend 260 is formed, tool 268 may be removed and bus wire 222 is soldered to the printed circuit board 212. The bus wire 222 preferably extends through and beyond the printed circuit board 212 by a length long enough to allow the flexible bend 260 to be formed thereabove to a desired height and the solder joint to be formed thereafter.

Figure 12:
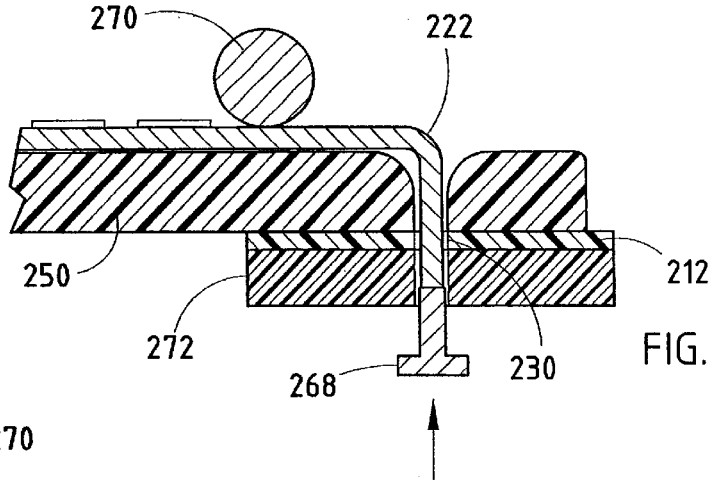
FIG. 12 is a partial cross-sectional view of the BEDC and PCB showing yet another assembly process for forming a flexible strain relief bend in the electrical interconnection.
Figure 13:
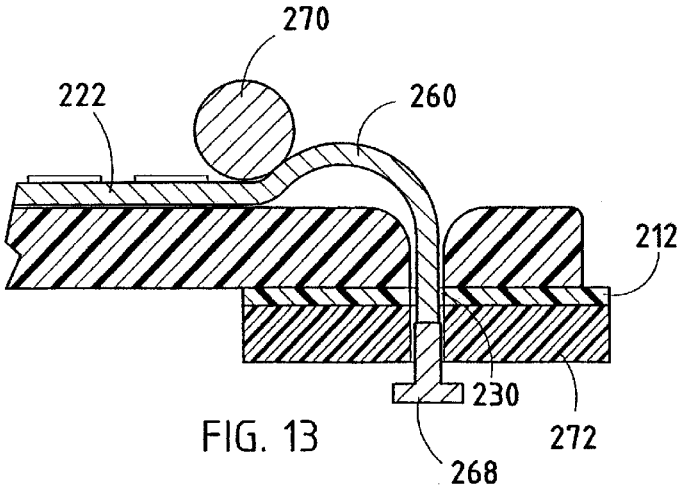
FIG. 13 is a partial cross-sectional view of the BEDC and PCB shown in FIG. 12, further illustrating the formation of the flexible bend in the electrical interconnection.

Referring to FIGS. 12 and 13, another embodiment is shown for forming the flexible bend 260 in bus wire 222 for a flat pack configuration. The routed bus wire 222 has a rounded ninety degree bend that allows the wire 222 to extend through an aperture 230 in printed circuit board 212, leaving a sufficient length of wire extending through the aperture 230 and below the printed circuit board 212. With the bus wire 222 in place, tool 268 is used to form a flexible strain relief loop 260 in wire 222 prior to soldering. The flexible loop 260 is formed by securing the bus wire 222 within an opening in a guide member 272, engaging a support member 270, such as a cylindrical anvil, to hold the bus wire 222 down on the BEDC 250, and applying an upward force on tool 268 that in turn pushes the end of bus wire 222 upward and against support member 270, thus forming the flexible bend 260. Once the flexible bend 260 is formed, the interconnection is ready for soldering.

Figure 14:
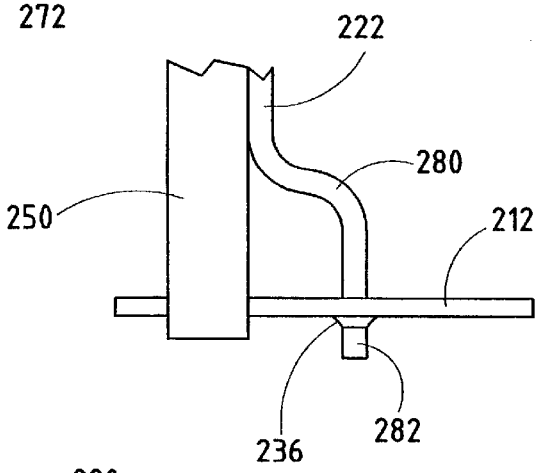
FIG. 14 is a side view of a portion of the BEDC and PCB illustrating an L-pack electrical interconnection according to a further embodiment of the present invention.

Referring to FIG. 14, an electrical interconnection is shown according to yet another embodiment for facilitating the implementation of an L-shaped configuration. The routed bus wire 222 is terminated with a bend 280 and extends through a prepared through hole in printed circuit board 212. The bus wire 222 then undergoes a traditional solder process to form solder joint 236. According to this embodiment, the bottom end of bus wire 222 may extend beyond the bottom contact surface of printed circuit board 212 to provide added alignment and stability during the solder and final assembly processes.

Figure 15:
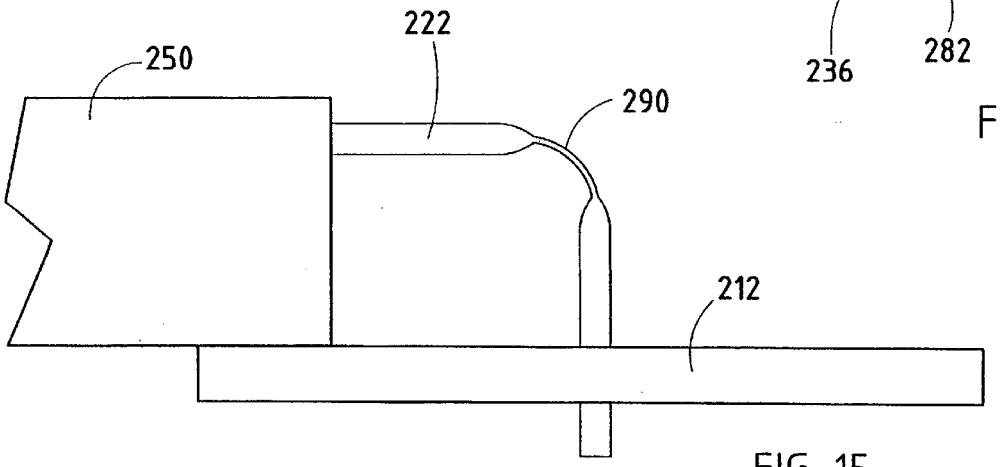
FIG. 15 is a side view of a portion of the BEDC and PCB further illustrating an electrical interconnection having a coined surface according to yet a further embodiment of the present invention.

The routed bus wire 222 may further include a coined section 290 as shown in FIG. 15. The coined section 290 provides a generally flat section of reduced thickness, preferably formed at the intended location of the bend, to reduce bending force and subsequent strain on the solder joint, particularly during the flat pack bending process as described herein. The reduced thickness may be formed on either the inside or outside of the wire relative to the bend, and is preferably formed on both sides as shown. The coined section 290 may be provided on any of the above electrical interconnections described herein.

Accordingly, the present invention provides for a unique electrical interconnection that connects the routed bus wire of a bussed electrical distribution center to a printed circuit board. The present invention advantageously provides for such an electrical interface with enhanced flexibility, that has reduced sensitivity to vibration and other forces, and can be made available at low cost.

To those skilled in the art to which this invention appertains, the above described preferred embodiments may be subject to change or modification. Such change or modification can be carried out without departing from the scope of the invention, which is intended to be limited only by the scope of the appended claims.

What is claimed is:

1. An interconnect system for connecting a printed circuit board to a bussed electrical distribution center, said system comprising:

a bussed electrical distribution center having a main assembly and at least one bus wire;

a printed circuit board having a substrate and a conductive path fabricated thereon; and an electrical interconnect connecting said at least one bus wire on said bussed electrical distribution center with said conductive path on said printed circuit board, said electrical interconnect having a flexible bend located between the bussed electrical distribution center and the printed circuit board to provide a flexible interconnection, wherein said electrical interconnect comprises a strain relief loop.

2. The interconnect system as defined in claim 1, wherein said flexible bend is formed by forcing one end of said wire relative to the opposite end of said wire.

3. The interconnect system as defined in claim 1, wherein said flexible bend is formed against the surface of a support member.

4. The interconnect system as defined in claim 1, wherein said bussed electrically distribution center further comprises a main insulation assembly having a plurality of apertures and a plurality of wiring channels selectively intersecting the plurality of apertures, with said at least one bus wire resident in said plurality of wiring channels, and said main insulation assembly having a recess intersecting a selected number of apertures in the plurality of apertures.

5. The interconnect system as defined in claim 1, wherein said substrate of said printed circuit board has an aperture intersecting said conductive path and the bus wire extends into said aperture.

6. The interconnect system as defined in claim 1, wherein said interconnect system is employed for use in an automotive vehicle.

7. The interconnect system as defined in claim 6, wherein said interconnect system is employed in an instrument panel of said automotive vehicle.

8. An interconnect system for directly connecting a printed circuit board to a bussed electrical distribution center, said system comprising:

a bussed electrical distribution center having a main assembly and at least one bus wire;

a printed circuit board having a substrate, a conductive path, and an aperture intersecting the conductive path for receiving the at least one bus wire; and an electrical interconnect directly connecting said at least one bus wire on said bussed electrical distribution center with said conductive path on said printed circuit board and including a solder joint formed at the connection, said electrical interconnect having a flexible strain relief bend located between the bussed electrical distribution center and printed circuit board to provide a flexible strain relieved interconnection, wherein said electrical interconnect comprises a strain relief loop.

9. The interconnect system as defined in claim 8, wherein said interconnect system is employed for use in an automotive vehicle.

* * * * *